US006427107B1

(12) United States Patent
Chiu et al.

(10) Patent No.: US 6,427,107 B1
(45) Date of Patent: Jul. 30, 2002

(54) POWER MANAGEMENT SYSTEM AND METHOD

(75) Inventors: George T. Chiu; Grant A. Ingram; Matthew A. Franchek, all of West Lafayette, IN (US); Richard G. Ingram, Saint Charles, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/894,357

(22) Filed: Jun. 28, 2001

(51) Int. Cl.[7] ..... G06F 7/00

(52) U.S. Cl. ..... 701/50; 701/36; 307/9.1; 172/2

(58) Field of Search ..... 701/50, 36; 307/9.1, 307/11; 702/44; 318/139; 180/165; 172/2

(56) References Cited

U.S. PATENT DOCUMENTS 4,679,396 A 7/1987 Heggie
5,295,353 A 3/1994 Ikari
5,303,552 A 4/1994 Webb
5,525,043 A 6/1996 Lukich
5,540,051 A 7/1996 Maruyama et al.
5,570,286 A 10/1996 Margolis et al.
5,678,462 A 10/1997 Bausenhart et al.
5,680,760 A 10/1997 Lunzman
5,762,475 A 6/1998 Maddock et al.
5,845,221 A 12/1998 Hosokawa et al.
5,848,531 A 12/1998 Nakamura et al.
5,930,996 A 8/1999 Nakamura et al.
5,967,756 A 10/1999 Devier et al.
6,014,996 A 1/2000 Egging et al.
6,047,545 A 4/2000 Deininger
6,067,493 A 5/2000 Adachi et al.

*Primary Examiner*—Yonel Beaulieu
(74) *Attorney, Agent, or Firm*—Nexsen, Pruet, Jacobs & Pollard

(57) ABSTRACT

A power management controller for a machine which may be subjected to work assignments taxing the available power of the machine which automatically allocates power to the machine subsystems to ensure continued acceptable machine performance as power demands change.

12 Claims, 5 Drawing Sheets

POWER MANAGEMENT SYSTEM AND METHOD

TECHNICAL FIELD

This invention relates generally to controlling power to the subsystems of a construction machine and particularly to distributing available power to the machine subsystems by using a power management controller responding to predetermined priorities and operational requirements. In the example given, the invention relates to the implement and drive train subsystems of a construction machine.

BACKGROUND

In operating construction machinery the available power, typically provided by an internal combustion engine, is mainly consumed by three major systems; namely, a power steering system, an implement control system and a power train system for propulsion. For safety reasons, it is typical for the steering system to be given first priority to available power. The remaining power is available for consumption by the implement operating system and the power train system.

In operating a wheel loader to load rock in a raised hopper of a rock crusher, the wheel loader scoops up a bucket load of raw material and travels toward the hopper with the bucket relatively low in interest of visibility and machine stability. Although some rock crusher hoppers are located on level ground, it is common practice to build a loading ramp to the hopper, the length and grade of which varies from site to site. As the loader approaches the hopper, the operator raises the bucket in anticipation of dumping the load when the hopper is reached. Thus the implement operating system and the power train system are simultaneously consuming power.

In prior power management systems the implement operating system is given priority to the available power for the power train system; however, the available power for the power train may be so limited as to produce excessively slow travel speed when raising the bucket and traveling up a relatively steep loading ramp. Excessively slow speed reduces operating efficiency of the wheel loader. Control systems heretofore provided for construction machinery have not allocated power to implement and power train systems to ensure their simultaneous operation in an acceptable manner.

In U.S. Pat. No. 5,525,043 issued Jun. 11, 1996 to Michael S. Lukich for a Hydraulic Power Control System, a method and apparatus are described for controlling a hydraulic control system in a hydraulic excavator to limit engine lug. The displacement of a hydraulic pump driven by the engine is reduced in response to the engine load increasing above a predefined level to prevent the engine from stalling. This method and control apparatus would not provide satisfactory minimum/maximum allocation of power to implement and drive train systems such as used in wheel loaders.

U.S. Pat. No. 6,047,545 issued Apr. 11, 2000 to Horst Deininger for Hydrostatic Drive System discloses a lift truck power system in which a hydraulic steering system is given first priority, a hydraulic work system is given second priority and a hydrostatic drive system is given third priority. This and other priority systems employed in wheel loaders give rise to the problem of excessively slow travel speed when traveling with a load of rock up a loading ramp to a rock crusher hopper and simultaneously raising the bucket in anticipation of dumping the raw material in the hopper.

U.S. Pat. No. 5,295,353 issued Mar. 22, 1994 to M. Ikari for a Controlling Arrangement for Travelling Work Vehicle illustrates and describes a wheel loader having a torque converter and two fixed capacity hydraulic pumps supplying pressure fluid to the valves controlling boom lift and bucket tile actuators. One of the two hydraulic pumps is unloaded when the accelerator pedal is at full throttle and the engine speed is under a predetermined speed. Although this control system provides a change in allocation of power when the engine does not increase speeds in response to a requested speed increase, the control does not provide for adjustment of the power allocations to the implement and power train subsystems based on the operator's desired commands.

The present invention is directed to overcoming one or more of the problems as set forth above.

SUMMARY OF THE INVENTION

In one aspect of the present invention, the available power, after satisfying vehicle steering requirements, is allocated to an implement subsystem and power train system.

The allocation of power to the implement subsystem and the power train subsystem is controlled by a power management system which is programmed to allocate a quantity of available power to the implement subsystem, such quantity falling between predetermined maximum and minimum percentages of the available power depending on the difference between desired travel speed and actual travel speed.

The maximum and minimum percentages of the available power allocated to the implement subsystem may be adjusted to provide efficient machine performance for particular machine work assignments. Adjustable set points are preferably provided to establish the minimum difference between the desired and the actual travel speed at which the maximum percent of available power is allocated to the implement subsystem and to establish the maximum difference in the desired and the actual travel speed at which the minimum percent of available power is allocated to the implement subsystem. An on-board compute is programmed to provide a smooth change in power allocation to the implement subsystem as changes occur in the difference between requested travel speed and actual travel speed.

BRIEF DESCRIPTION OF THE DRAWINGS

An embodiment of the invention is illustrated in the accompanying drawings in which.

DETAILED DESCRIPTION

Figure 1:
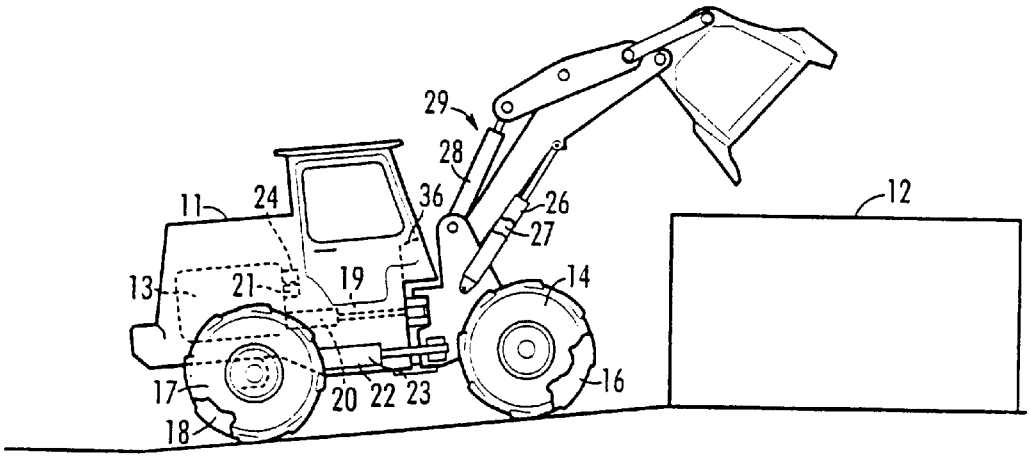
FIG. 1 is a side view of a wheeled Loader dumping raw material into a rock crusher hopper.

In FIG. 1 a wheel loader 11 is shown dumping rocks into a hopper 12 of a rock crusher. The wheel loader 11 is equipped with an internal combustion engine 13 which drives a pair of front wheels 14, 16 and a pair of rear wheels 17, 18 through a power train subsystem 19 which includes a transmission 20. The engine 13 also drives a pump 21 supplying hydraulic power to a steering subsystem 22 which includes a steering cylinder 23, and drives a variable displacement pump 24 supplying pressurized hydraulic fluid to implement lift and tilt valves, not shown, controlling a pair of cylinders 26, 27 and a tilt cylinder 28 of an implement subsystem 29.

When either of the control valves, not shown, for operating the lift and tilt cylinders 26, 27, 28, are shifted to a cylinder actuating position the variable displacement pump 24 is automatically stroked from neutral to a pressure fluid supplying condition, the displacement adjustment being dependent on the extend of the adjustment of the implement valve or valves.

For safety reasons the steering subsystem is given first priority to engine power. The power left over, after satisfying the steering subsystem power requirements, is available for consumption by the implement and power train subsystems and is hereinafter referred to as calculated power available or available power.

Figure 2:
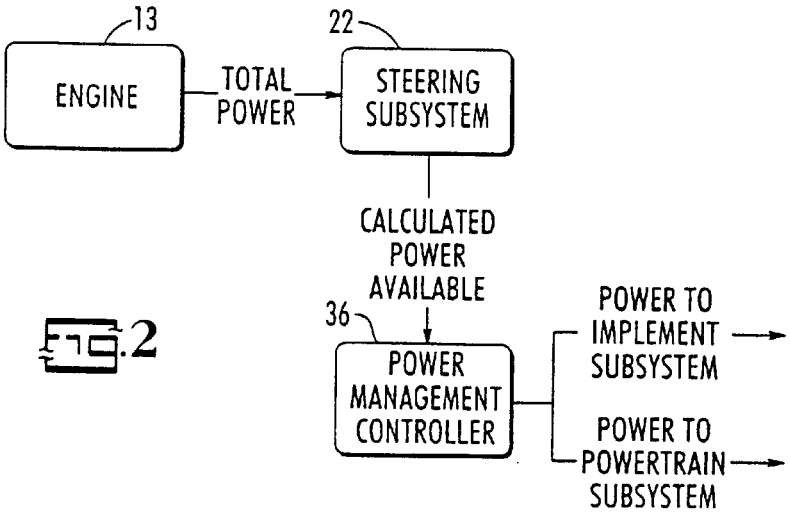
FIG. 2 is a diagram showing the flow of power from an engine to power consuming subsystems.

Referring to FIG. 2, a power management controller 36 on board the wheel loader 11 calculates the available power after deducting steering power being consumed and makes an allocation of the calculated power available to the implement subsystem 29. The remaining power is available for consumption by the power train subsystem 19.

The power management controller 36 is fed a signal such as a number indicative of the rated horse power of the engine 13 and a steering power signal, such as a number, based on desired cylinder speeds and pump pressure, which permit the power management controller 36 to calculate the power available (PA) for distribution to the implement and power train subsystems 29, 19.

Figure 3:
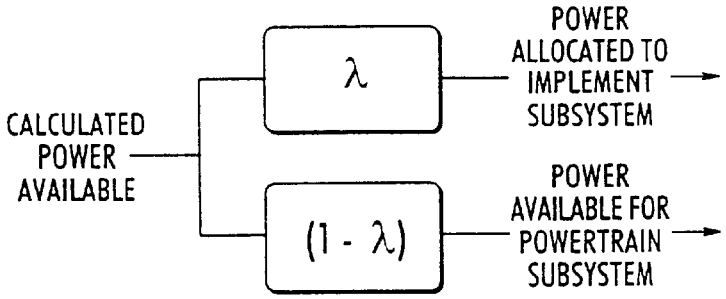
FIG. 3 is a diagram illustrating the basic allocation of power to two subsystems.

FIG. 3 shows the calculated power available divided between the implement and power train subsystems. The fractional allocation $\lambda$ of available power to the implement subsystem 29 automatically determines the power allocation to the power train subsystem 19, represented by 1-$\lambda$. Thus, represents the fraction of the available power allocated to the implement subsystem 29 and 1-$\lambda$ designates the fraction of available power allocated to the power train subsystem 19. Since the wheel loader 11 is equipped with a variable displacement pump 24 delivering pressurized fluid to the implement subsystem, the power management controller 36 allocates power by changing the amount of pressurized fluid flowing to the implement subsystem control valves, not shown. This is done by the power management controller 36 changing the displacement of the variable displacement pump 24.

A power distribution algorithm is loaded into a computer in the power management controller 36 which programs the computer to cause the power management controller 36 to vary the allocation of power to the implement subsystem 29 in response to deficiencies in the actual travel speed as compared to the desired travel speed of the wheel loader. A signal indicative of the desired travel speed is delivered to the power management controller 36 by a sensor, not shown, associated with a speed control, not shown, operated by the machine operator. For instance the sensor could sense displacement of an acceleration pedal. An actual travel speed signal is delivered to the power management controller by a travel speed sensor associated with the power train subsystem 19. The travel speed sensor may sense the speed of the output shaft of the transmission of the power train subsystem 19, which is indicative of the actual travel speed of the wheel loader.

Figure 4:
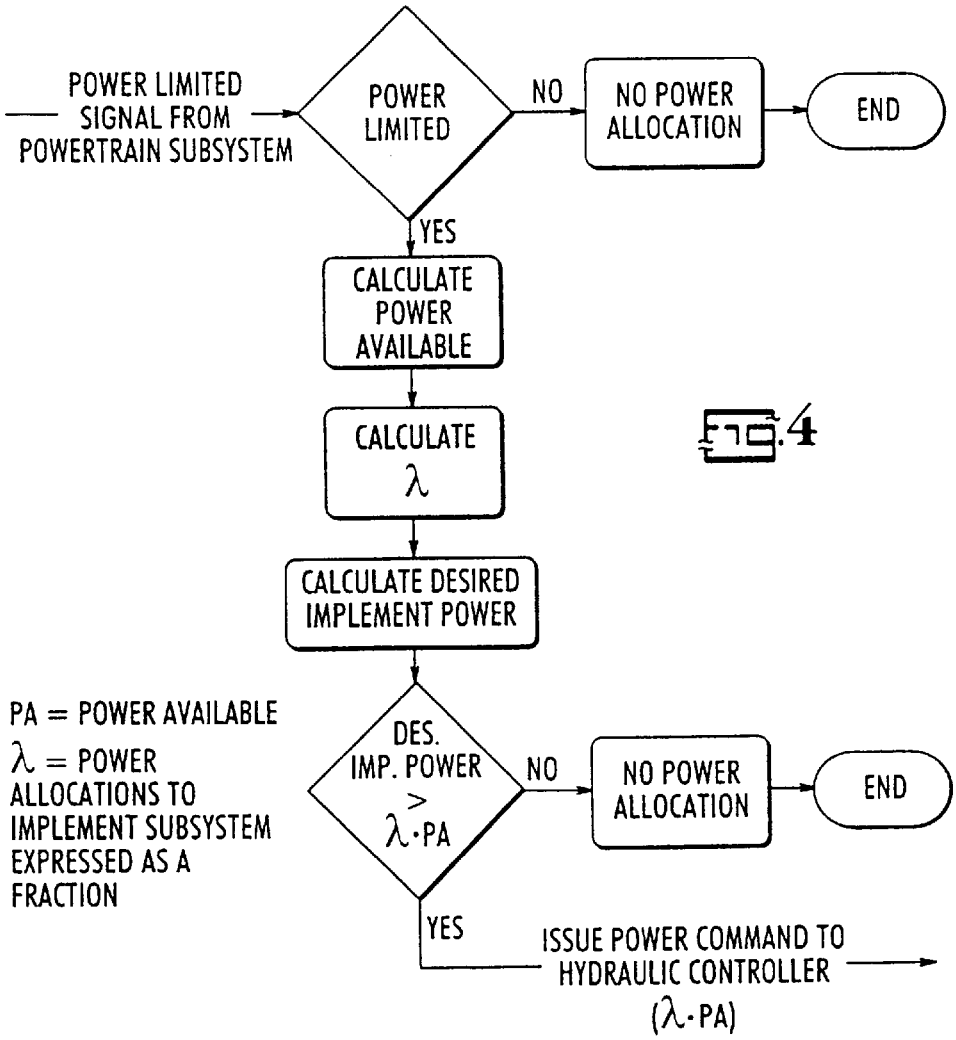
FIG. 4 is a diagram illustrating operation of a power management controller.

The operation of the power management controller 36 is illustrated in FIG. 4. The power management controller 36 is only active when a power limited condition is determined by the transmission controller. In the event the wheel loader 11 is power limited, the power available (PA) for allocation is calculated. In addition, the value of $\lambda$ and the operator's desired implement power are calculated by the power management controller 36. The implement tilt and lift levers, not shown, associated with the operator's desired lift and tilt cylinder velocities delivers a signal to the power management controller 36 which is indicative of the desired power for the implement subsystem 29. If the desired implement power is less than the power allocated to the implement subsystem 29, then the power management controller 36 will not issue an implement subsystem power command. In other words, the power consumed by the implement subsystem 29 will only be reduced if the operator is demanding more power for this subsystem than the power distribution algorithm would allocate. If the operator is demanding more power for the implement subsystem 29 than is allocated to the implement subsystem 29, the power management controller 36 (which changes the stroking of the variable displacement pump 29) will reduce the operator implement commands until the power consumed by the implement subsystem 29 is equal to the power allocated to that subsystem.

The power management controller 36 is programmed to provide power to the implement subsystem 29 between predetermined minimum ($\lambda$min) and maximum ($\lambda$max) fractions of the available power.

The program entered into the computer is the equation:

$$\lambda=\lambda\min+(\lambda\max-\lambda\min)(1-3x2+2x3)$$

where x=Abs(Requested-actual trans speed)−$\lambda$max setpoint $\lambda$min setpoint−$\lambda$max setpoint and Abs denotes that the difference in requested transmission speed and actual transmission speed is expressed as an absolute value. In other words, if the difference is a negative number, it is transformed to a positive number.

Figure 5:
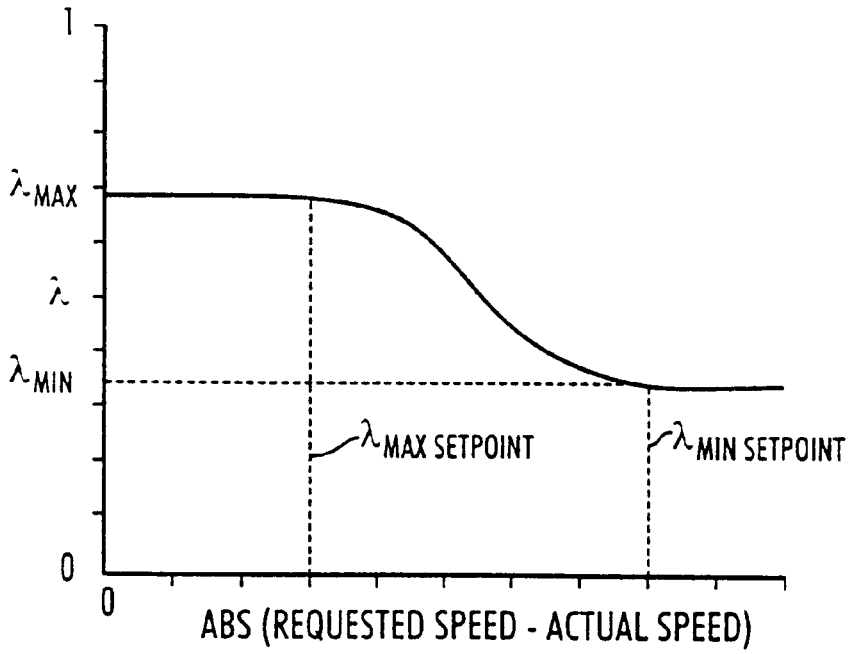
FIGS. 5, 6, 7, 8 and 9 are curves illustrating power allocation to the implement subsystem

FIG. 5 shows $\lambda$ as a function of the transmission speed error in accordance with the before mentioned equation. The $\lambda$ as a function of the transmission speed error in accordance with the before mentioned equation. The $\lambda$ scheduling function has three segments. The first segment extends from zero to a $\lambda$max setpoint. The second segment is a transition lying between the $\lambda$max setpoint and a $\lambda$min setpoint where the value of $\lambda$ ranges from $\lambda$max to $\lambda$min. the second segment of the curve, a transition part, is represented by an equation:

$$\lambda=1-3x2+2x3$$

which is a simple third order polynomial not especially computationally demanding of the computer of the power management controller 36. The third segment of the curve extends beyond the $\lambda$min setpoint where $\lambda$ is a fixed value of $\lambda$min. As will be noted the third order polynomial expression, 1−3x2+2x3, is part of the equation for the curve of FIG. 5 and also the later discussed curves shown in FIGS. 6–9.

There are four parameters which define the $\lambda$ scheduling function; (1) $\lambda$max, (2) $\lambda$min, (3) $\lambda$max setpoint, and (4) $\lambda$min setpoint. Each parameter has physical meaning and can be specified based on operator perception. The maximum value of λ, (λmax), represents the maximum fraction of power available to the implement subsystem. The parameter λmax also determines the minimum fraction of power available for the power train subsystem 19. Furthermore, λmin represents the minimum fraction of power available for the implement subsystem 29 and determines the maximum fraction of power available for the power train subsystem 19.

The values of the parameters entered into the computer program, including the λmax setpoint and the λmin setpoint, are normally based on the transmission speed error incurred at a particular job site. The smallest transmission speed error selected for a given site (λmax setpoint) may also depend on the programmed values of λmax and λmin. Similarly, the largest transmission speed error selected for a given site (λmin setpoint)is dependent on the values given λmax and λmin. These parameters also affect the sensitivity of the function λ. The function λ may become too sensitive to changes in transmission speed error when transitioning between λmax λmin over a short interval. In these cases, power may be distributed erratically due to fluctuations in transmission speed error. For this reason λmax setpoint and λmin setpoint must be chosen such that λ is not significantly affected by normal fluctuations or transmission speed error.

Figure 8:
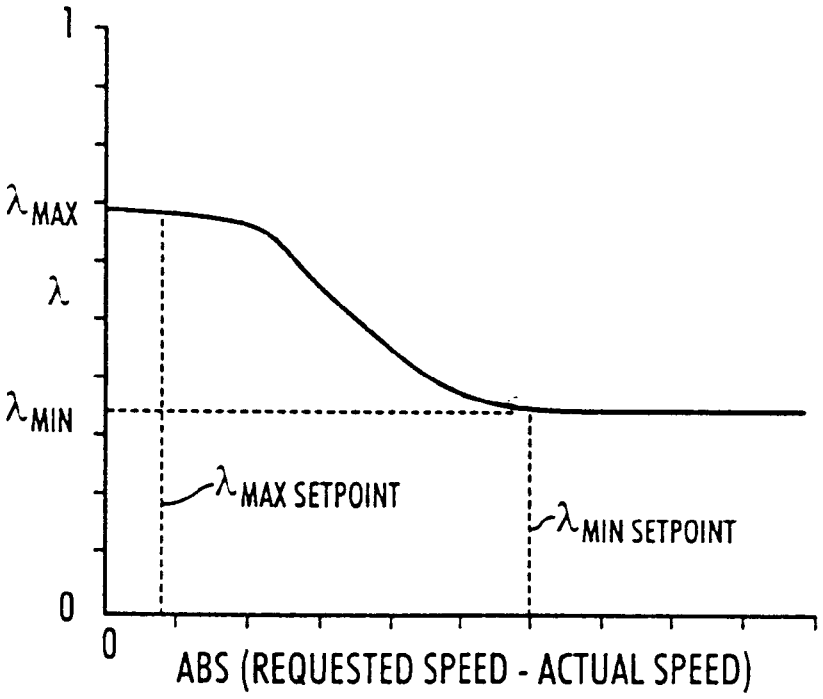

FIG. 8 shows the values of λ with reduced λmax setpoint and λmin setpoint values. The power management controller 36 delivers the programmed maximum fraction (λmax) of available power to the implement subsystem 29 until the absolute value of the difference between the requested (desired) and actual power train speed rises to a predetermined RPM (λmax setpoint) The power management controller 36 delivers a predetermined minimum fraction (λmin) of the available power to the implement subsystem 29 upon the absolute value of the difference between the requested speed and the delivered speed exceeding a predetermined RPM.

Figure 7:
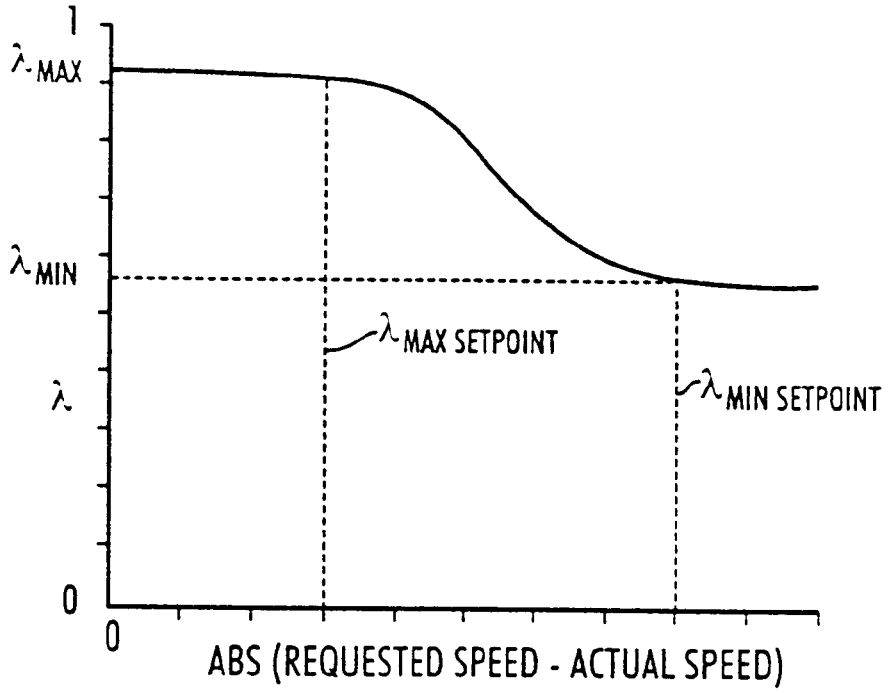

FIG. 7 shows the same λmax and λmin setpoints as used in FIG. 5; however, the λmax and λmin values have been increased and thus the portion or fraction of available power allocated to the implement subsystem 29 has been increased, and, consequently, less power is available for the power train subsystem 19 than was available when the power management controller 36 controlled power allocation according to the curve of FIG. 5.

Figure 6:
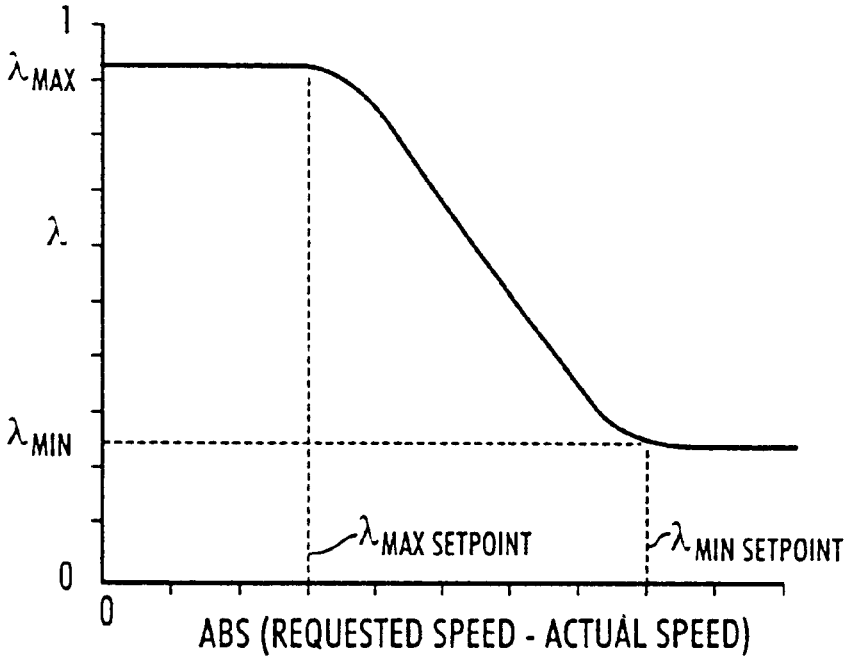

FIG. 6 shows the λmax and λmin values adjusted up and down, respectively. As compared to FIG. 5, more implement subsystem 29 power (and less power to the power train subsystem 19) is allocated in the first section of the allocation curve and less implement subsystem power 29 is allocated than in FIG. 5 in the third section of the allocation curve.

Figure 9:
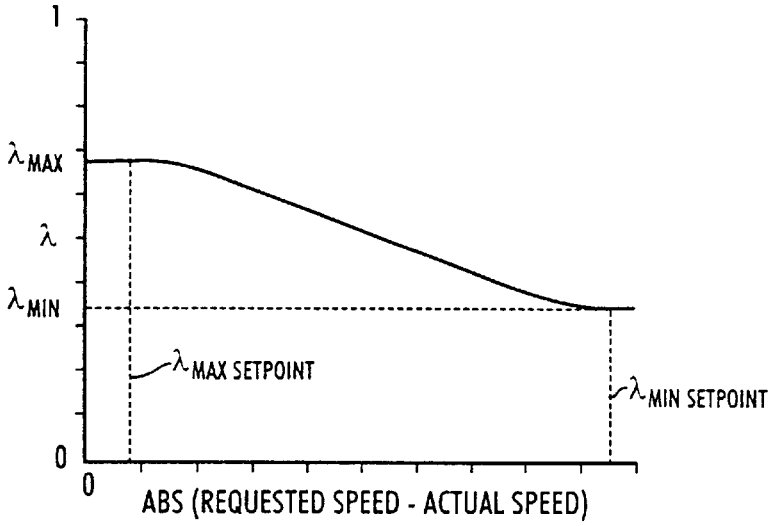

FIG. 9 shows the operating curve of power allocation to the implement subsystem 29 with the λmax and λmin settings the same as in FIG. 5 but with changes in the λmax setpoint and the λmin setpoint. The allocation of power (λ) to the implement subsystem 29 begins to be reduced at a rather low λmax setpoint and reduction continues to a rather high λmin setpoint.

Figure 10:
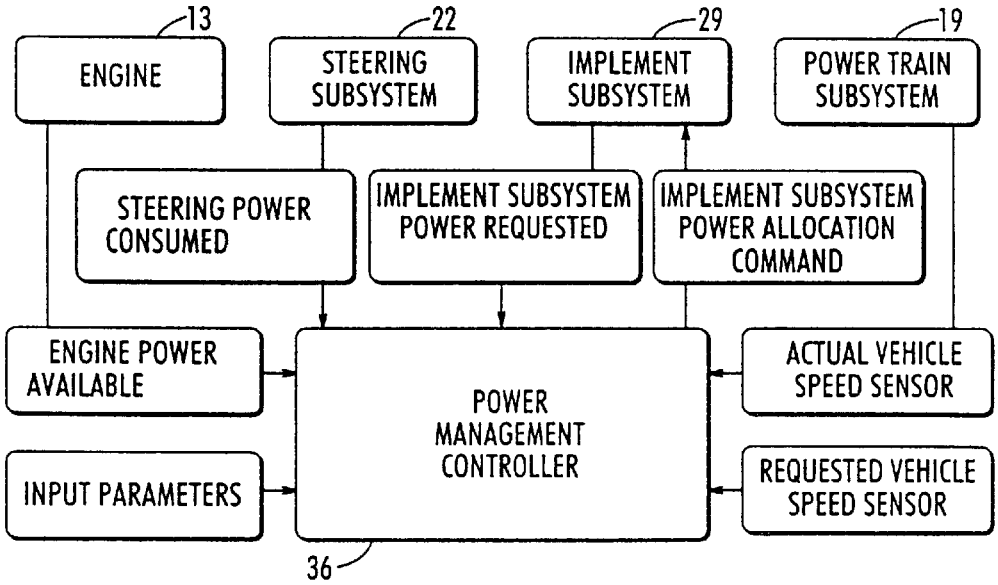
FIG. 10 is a block diagram illustrating the operation of a power management controller in an engine driven construction machine.

FIG. 10 is a block diagram of the power management system of this invention in an engine powered vehicle having power consuming steering, implement and power train subsystems.

INDUSTRIAL APPLICABILITY

The power management controller herein described is programmed to allocate quantities of power to the implement power subsystem 29 between maximum and minimum fractions (λ) of the available power dependent on the transmission speed error. Transmission speed error is the absolute value of the difference between the desired speed and the actual transmission speed. The chosen maximum and minimum allocations (λmax, λmin) of available power to the implement subsystem 29 are input into the computer of the power management controller together with λmax setpoint and λmin setpoint values. These parameters are selected and input into the computer to provide efficient machine operation for a particular work function and/or particular work site. In wheel loader applications, such as loading rock in the illustrated rock crusher hopper 12, maintaining a reasonable travel speed while raising the bucket in preparation for the dumping of the raw material into the hopper, is necessary to achieve good loader productivity. When operating a construction machine with the power management system of this invention, more power is given to the power train subsystem when there are large differences between actual and desired vehicle speeds. Conversely, more power is given to the implement subsystem when there are small differences between the actual and desired vehicle speeds. By integrating the power consuming subsystems of the construction machine through actively distributing power as directed by the power management controller 36, the actual power limitation of the machine are not readily perceived by the operator.

Each of the four parameters (λmax, λmin,λmax setpoint, λmin set point) of the λ scheduling function may be chosen and entered into the computer in response to operator preferences or feedback. These parameters allow for a customized power distribution in the construction machine for any operator and/or for any particular work site. For example, one operator may perceive excessively slow travel speed while lifting a full bucket as a power limitation. Another operator may perceive power limitation from observing slow implement responses. In either case, the parameters of the λ scheduling function may be set independently for each operator such that the power limitations of the wheel loader are not readily perceivable. Furthermore, the parameters that define the function of λ have physical meaning. This allows for easier tuning in the field.

This invention provides flexibility in the distribution of power in construction machinery based on the perception of power limited modes by any operator. When this power management controller is applied to wheel loaders there is an important additional benefit of reducing the cycle time required for loading and dumping operations, such as loading rock crusher hoppers.

Other aspects, objects and advantages of this invention can be obtained from a stud of the drawings, the disclosure and the appended claims.

What is claimed is:

1. A method of operating a construction vehicle having a steering subsystem, an implement subsystem and a power train subsystem and a source of power for operating said subsystems, said method comprising:

providing a power management controller operable to allocate power to said implement subsystem, determining the amount of power produced by said source of power that is available for consumption by said steering, implement and power train subsystems and transmitting a signal indicative of said amount to said power management controller, providing a signal to said power management controller indicative of the power required by said steering subsystem, said power management controller calculating the available power for said implement and power train subsystems by subtracting the power required by the steering subsystem from the amount of power available to said steering, implement and power train subsystems.

providing a signal to said power management controller indicative of the transmission output speed being requested, providing a signal to said power management controller indicative of the actual transmission output speed, said power management controller comparing said requested transmission output speed with said actual transmission output speed and calculating a speed error, and programming said power management controller to make power allocations to said implement subsystem between a maximum implement subsystem power allocation and a minimum implement subsystem power allocation dependent on said speed error.

2. The method of claim 1 wherein said maximum and minimum power allocations are adjustable.

3. The method of claim 1 wherein said power allocations to said implement subsystem between said maximum allocation and said minimum allocation change smoothly with changes in said speed error.

4. The method of claim 3 including the step of providing maximum and minimum implement subsystem power allocation setpoints at predetermined speed errors, said power allocations being made between said setpoints being dependent on said speed errors between said setpoints.

5. The method of claim 4 wherein said power allocation setpoints are adjustable.

6. The method of claim 4 wherein said power allocation is a function of said speed error expressed by a smooth function.

7. The method of claim 6 wherein said power allocations between said setpoints define a curve having the shape of a third order polynomial, $$\lambda=1-3x^2+2x^3,$$

where x is the speed error expressed as the fraction of the requested speed actually delivered and $\lambda$ is the power allocated to the implement subsystem expressed as a fraction of said available power for said implement and power train subsystems.

8. The method of claim 4 wherein said power allocation to said implement subsystem is expressed as $$\lambda=\lambda\min+(\lambda\max-\lambda\min)(1-3x^2+2x^3)$$

where x=Abs(Requested-actual transmission speed)−$\lambda$max setpoint $\lambda$min setpoint−$\lambda$max setpoint and where Abs designates that the difference between the requested transmission speed and the actual transmission speed is expressed as a positive value.

9. In a construction vehicle having a power steering subsystem, an implement subsystem, a power train subsystem and an engine supplying power to said subsystems, the combination comprising:

a power management controller operable to allocate power to said implement subsystem, mechanism operable to deliver a signal to said power management controller indicative of the engine power available for delivery to said subsystems, a steering power sensor sensing power consumed by said steering subsystem and connected in signal delivery relation to said power management controller, a vehicle speed control by which an operator requests desired vehicle speed, a sensor associated with said speed control and connected to said power controller to deliver a signal to said power management controller indicative of requested speed, a vehicle speed sensor associated with said power train subsystem and connected in signal delivery relation to said power management controller indicative of the actual vehicle speed, said power management controller calculating a vehicle speed error and calculating power available for delivery to said implement and power train subsystems, by subtracting power being consumed by said steering system from said power available for delivery to said steering, implement and power train subsystems, and allocating power to said implement subsystem between predetermined maximum and minimum allocations of said power available for delivery to said implement and power train subsystems wherein said implement subsystem power allocation is dependent on said speed error.

10. The construction vehicle of claim 9 wherein said implement subsystem power allocation is a smooth function of said speed error.

11. The construction vehicle of claim 10 wherein said power allocations between said maximum and minimum power allocations define a curve having the shape of a third order polynomial, $$\lambda=(1-3x^2+2x^3)$$

where $\lambda$ is said implement subsystem power allocation and x is said speed error.

12. The construction vehicle of claim 9 wherein said power management controller allocates power to said implement subsystems based on the function:

$$\lambda=\lambda\min+(\lambda\max-\lambda\min)(1-3x^2+2x^3)$$

where:

x=Abs(Requested-actual transmission speed)−$\lambda$max setpoint $\lambda$min setpoint−$\lambda$max setpoint and wherein Abs designates that the difference between the requested transmission speed and the actual transmission speed is expressed as a positive value.

* * * * *